US006666115B2

(12) United States Patent
Liu

(10) Patent No.: US 6,666,115 B2
(45) Date of Patent: Dec. 23, 2003

(54) MAGNETIC DRIVING TOOL HAVING A TELESCOPIC PIPE

(75) Inventor: Kuo Zhen Liu, Da Li (TW)

(73) Assignee: ICC Innovative Concepts Corp., Torrington, CT (US)

( * ) Notice: Subject to any disclaimer, the term of this patent is extended or adjusted under 35 U.S.C. 154(b) by 0 days.

(21) Appl. No.: 09/974,663

(22) Filed: Oct. 10, 2001

(65) Prior Publication Data

US 2002/0066340 A1 Jun. 6, 2002

Related U.S. Application Data

(63) Continuation of application No. 09/259,725, filed on Mar. 1, 1999, now Pat. No. 6,321,626, which is a continuation of application No. 08/957,968, filed on Oct. 21, 1997, now Pat. No. 5,878,637, which is a continuation-in-part of application No. 08/643,026, filed on May 2, 1996, now abandoned.

(51) Int. Cl.[7] ..... B25B 23/08
(52) U.S. Cl. ..... 81/451; 294/65.5; 7/138
(58) Field of Search ..... 7/138, 165, 168; 81/490, 177.4, 451; 294/65.5

(56) References Cited

U.S. PATENT DOCUMENTS

| | | | | |
|---|---|---|---|---|
| 2,471,764 A | * | 5/1949 | Miller | 294/65.5 |
| 2,718,806 A | | 9/1955 | Clark | |
| 2,834,241 A | | 5/1958 | Chowning | |
| 3,707,894 A | | 1/1973 | Stillwagon | |
| 4,448,097 A | | 5/1984 | Rocca | |
| 5,487,576 A | | 1/1996 | DuVivier | |
| 5,896,606 A | * | 4/1999 | Huang | 7/165 |
| 5,901,622 A | * | 5/1999 | Sweeny | 7/165 |
| 6,105,190 A | * | 8/2000 | Shiao | 7/165 |
| 6,163,911 A | * | 12/2000 | Lin | 7/165 |
| 6,164,172 A | * | 12/2000 | Huang | 7/165 |

FOREIGN PATENT DOCUMENTS

GB 718990 6/1952

OTHER PUBLICATIONS

Handy Twins International Co., LTD, Invoice No. HT–96/06006(A) dated Jun. 6, 1996.
Handy Twins International Co., LTD Invoice No. 004675–IN dated Jun. 18, 1996.
Handy Twins International Co., LTD Invoice No. 0004674–IN dated Jun. 18, 1996.
Product Packaging for 8 in 1 Screwdriver and Telescoping Magnetic Pick–Up Tool by Fineline. (3 pages).
Photograph of Screwdriver Tool, Fineline (2 Pages).
Advance Auto Parts Invoice No. 4674–IN Dated Jul. 10, 1996.
Advance Auto Parts Invoice No. 4671–IN Dated Aug. 2, 1996.
Advance Auto Parts Invoice No. 4762–In Dated Aug. 5, 1996.
Advance Auto Parts Invoice No. 5269–In Dated Sep. 23, 1996.

* cited by examiner

*Primary Examiner*—James G. Smith
(74) *Attorney, Agent, or Firm*—Kirkpatrick & Lockhart LLP; Anthony H. Handal

(57) ABSTRACT

A screwdriver comprises a handle, a hollow outer sleeve, at least an inner pipe, and a bit. The rear end of the outer sleeve connects to the handle. The inner pipe is inserted in the interior of the outer sleeve via the front opening of the outer sleeve. A magnetic chuck is disposed at the front end of the inner pipe. The magnetic chuck is inserted in the rear portion of the bit.

12 Claims, 3 Drawing Sheets

MAGNETIC DRIVING TOOL HAVING A TELESCOPIC PIPE

CROSS REFERENCE TO RELATED APPLICATION

This application is a continuation of my application Ser. No. 09/259,725 filed Mar. 1, 1999, now U.S. Pat. No. 6,326,626, which application is a continuation of my application Ser. No. 08/957,968 filed Oct. 21, 1997, now U.S. Pat. No. 5,878,637, which application is, in turn, a continuation-in-part of my application Ser. No. 08/643,026 filed May 2, 1996, abandoned. The disclosure of each of the aforesaid applications is hereby incorporated herein by reference thereto.

STATEMENT REGARDING FEDERALLY SPONSORED RESEARCH OR DEVELOPMENT (Not applicable)

BACKGROUND OF THE INVENTION

The invention relates to an extensible magnetic screwdriver. More particularly, the invention relates to an extensible screwdriver with a magnetic chuck.

The conventional screwdriver does not have any extensible rod. Thus the conventional screwdriver cannot reach a deep hole to screw or unscrew a bolt therein. If a bolt is unscrewed, the user cannot reach the deep hole to fetch the bolt. Further, the bit of any screwdriver may be fallen into the deep hole. The user cannot fetch the fallen bit with the conventional screwdriver.

SUMMARY OF THE INVENTION

An object of the present invention is to provide an extensible screwdriver with a magnetic chuck in order to absorb a bit with the magnetic chuck.

Another object of the present invention is to provide an extensible screwdriver with an extensible inner pipe in order to reach a deep hole.

Another object of the present invention is to provide an extensible screwdriver with plurality of extensible inner pipes in order to reach a deep hole.

Accordingly, a screwdriver comprises a handle, a hollow outer sleeve, at least an inner pipe, and a bit. The rear end of the outer sleeve connects to the handle. The inner pipe is inserted in the interior of the outer sleeve via the front opening of the outer sleeve. A magnetic chuck is disposed at the front end of the inner pipe. The magnetic chuck is inserted in the rear portion of the bit. When a bolt is fallen down in a deep hole of an article, the magnetic chuck of the inner pipe reaches the bolt and absorbs the bolt on the front end of the magnetic chuck. It is an option to provide two inner pipes in the interior of the outer sleeve in order to extend the magnetic chuck.

DETAILED DESCRIPTION OF THE INVENTION

Figure 1:
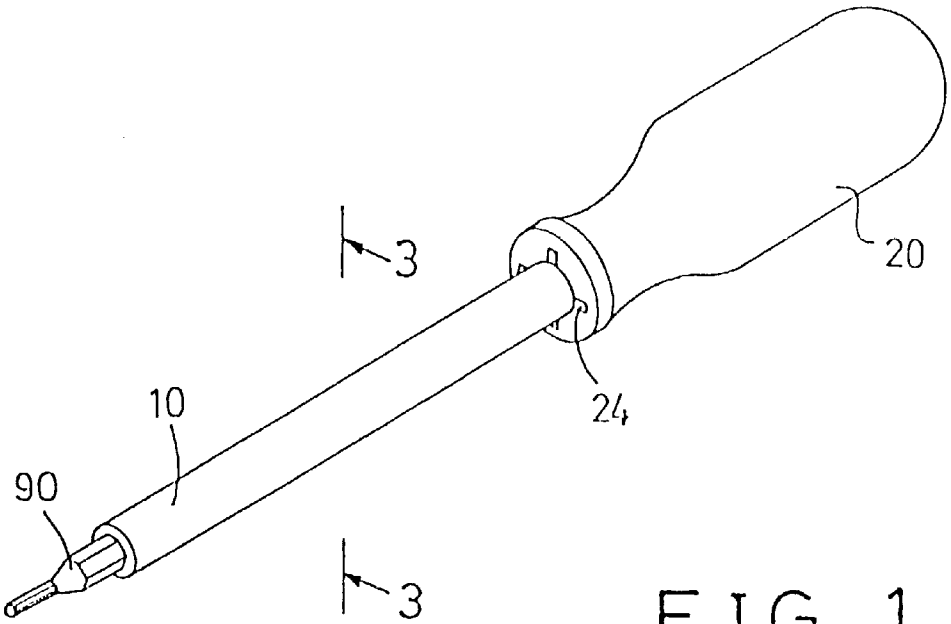
FIG. 1 is a perspective assembly view of a screwdriver of a preferred embodiment in accordance with the invention.
Figure 3:
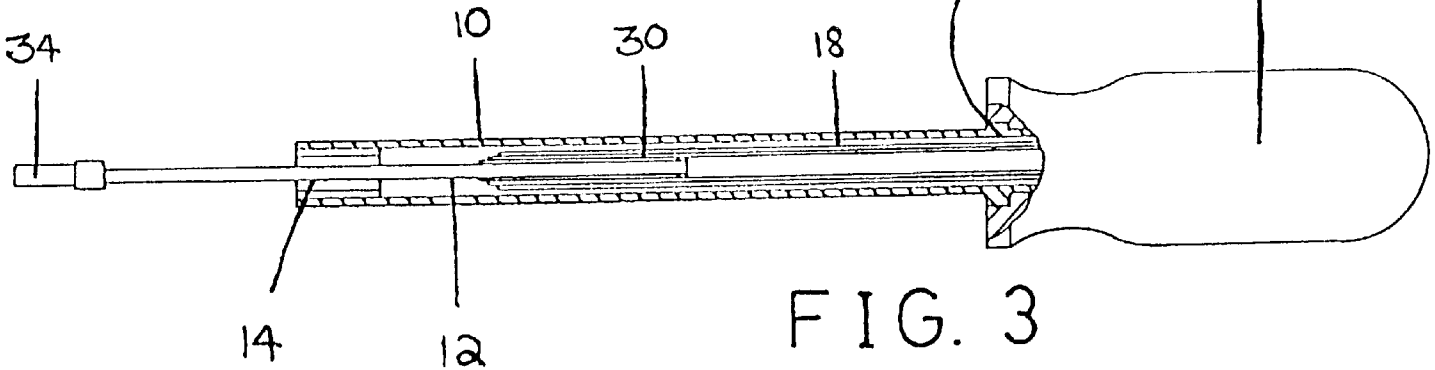
FIG. 3 is a cross-sectional view of FIG. 1.
Figure 2:
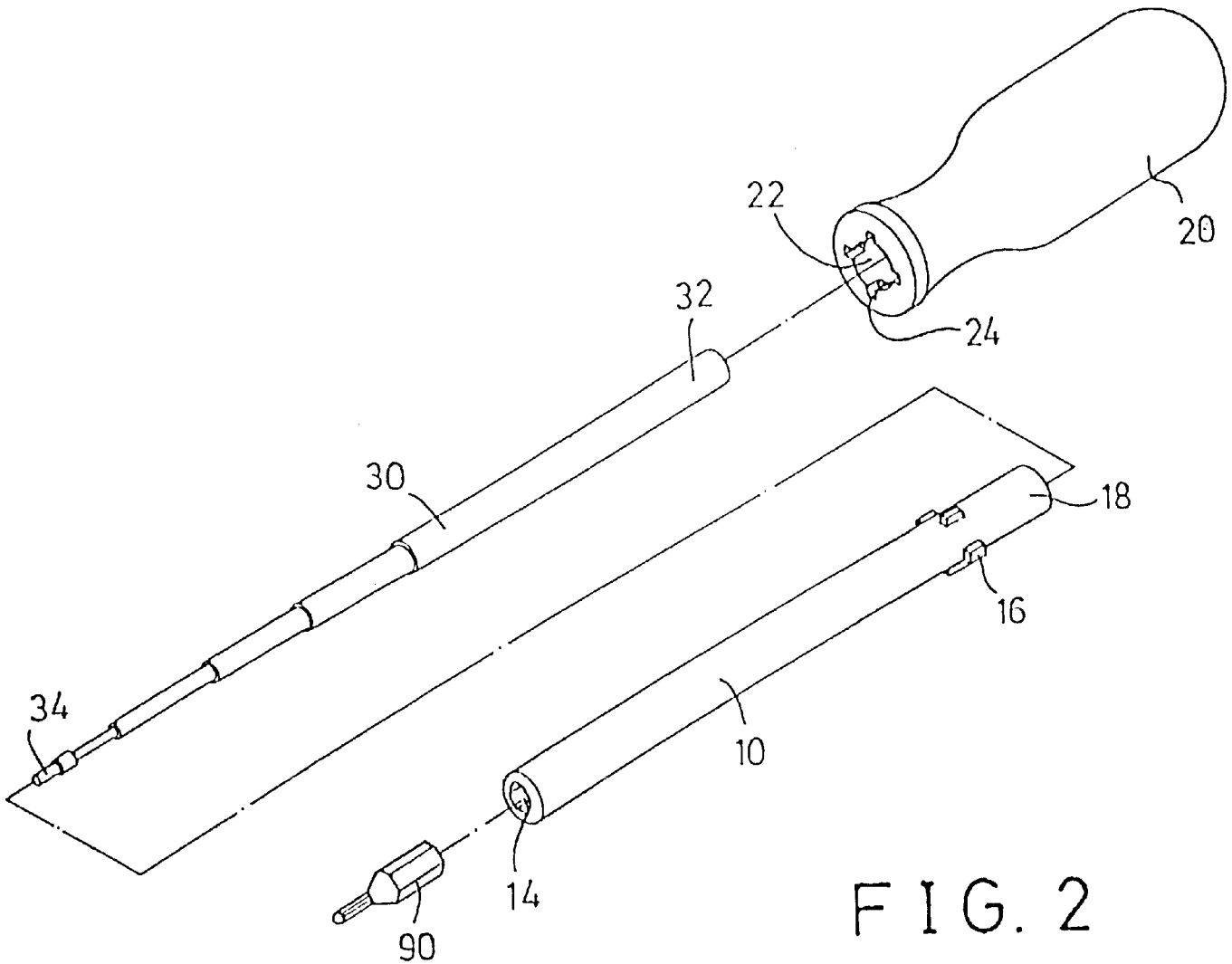
FIG. 2 is a perspective exploded view of FIG. 1.

Referring to FIGS. 1 to 3, a screwdriver comprises a handle 11, a hollow outer sleeve 10, at least an extensible inner pipe 14, and a bit 16. The rear end of the outer sleeve 10 connects to the handle 11. The inner pipe 14 is inserted in the interior 12 of the outer sleeve 10 via the front opening 13 of the outer sleeve 10. A magnetic chuck 15 is disposed at the front end of the inner pipe 14. The magnetic chuck 15 is inserted in the rear portion of the bit 16.

Figure 4:
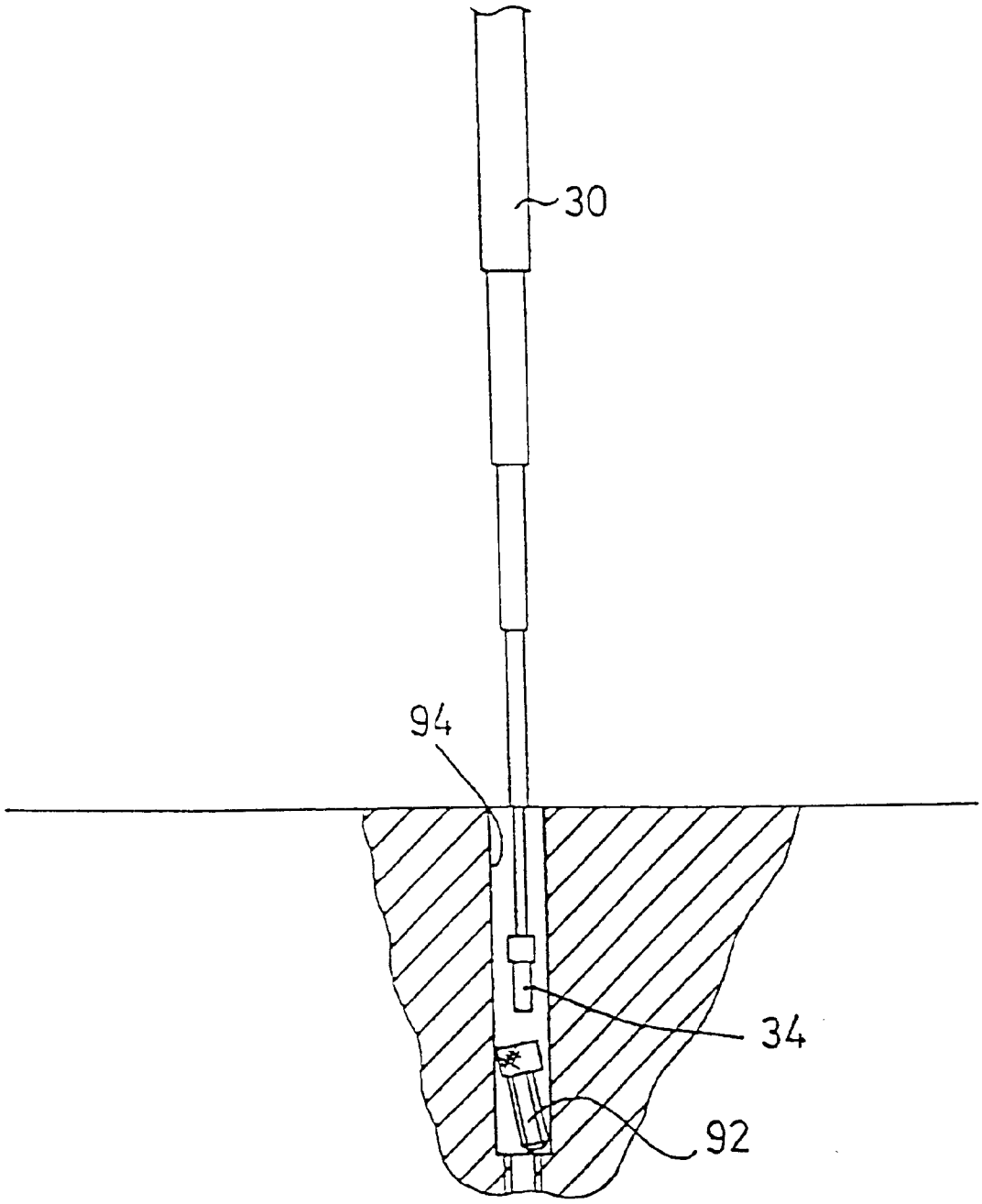
FIG. 4 is a schematic view illustrating the operation of a screwdriver.

Referring to FIG. 4, a bolt 92 is fallen down in a deep hole 91 of an article 90. The magnetic chuck 15 of the inner pipe 14 reaches the bolt 92 and absorbs the bolt 92 on the front end of the magnetic chuck 15.

It is an option to provide two inner pipes in the interior of the outer sleeve in order to extend the magnetic chuck.

The invention is not limited to the above embodiments but various modification thereof may be made. Further, various changes in form and detail may be made without departing from the scope of the invention.

What is claimed is:

1. A method of retrieving and rotatably driving a fallen magnetic fastener with a handheld driving tool, the driving tool employing a tool bit to drive the fastener, the method comprising:

a) extending an extendable member from the driving tool, the extendable member having one end secured to the driving tool and a magnetized tip at the other end, the magnetized tip being displaced to an extended position with respect to the driving tool wherein in the extended position the driving tool has an extended configuration;

b) manipulating the driving tool to fetch the fallen fastener by magnetic attraction of the fallen fastener to the magnetized tip;

c) retracting the extendable member to a retracted configuration of the driving tool;

d) attaching the tool bit to the driving tool after retracting the extendable member;

e) engaging the fetched fastener with the attached tool bit; and f) driving the fetched fastener with the driving tool.

2. A method according to claim 1 comprising employing a magnetic tool bit to drive the fastener wherein the extendable member is withdrawable by manually grasping and moving the tool bit and by magnetic attraction between the tool bit and the magnetized tip.

3. A method according to claim 2 wherein the extendable member is telescopic and contained within the tool in the retracted configuration of the extendable member, wherein the tool comprises an annular socket shaped to receive the magnetic tool bit wherein, in the retracted configuration, the tool bit is adjacent to the magnetized tip and wherein the method comprises withdrawing the magnetized tip through the annular socket by gripping and moving the tool bit whereby magnetic attraction holds the magnetized tip adjacent the tool bit to move with the tool bit thereby extending the extendable member.

4. A method of retrieving a fallen magnetic object using a handheld driving tool, the driving tool employing a tool bit to drive the fastener wherein the driving tool comprises; a handle, a hollow sleeve extending from the handle and having a tool bit-receiving annular socket on an end of the sleeve remote from the handle, an extendable member contained within the sleeve, the extendable member having a magnetized tip wherein, in a retracted configuration of the extendable member, a tool bit disposed in the annular socket is disposed magnetically adjacent to the magnetized tip, the method comprising:

a) withdrawing the extendable member from the driving tool, by gripping a magnetic bit disposed in the socket, the magnetic bit magnetically holding the magnetized tip of the extendible member whereby the magnetized tip is drawn through the socket as; and b) retrieving the fallen magnetic object with the driving tool, the extendable member being extended and the magnetized tip magnetically attracting the magnetic object.

5. A method according to claim 1 wherein the fallen fastener is in a deep hole.

6. A method according to claim 1 wherein the method is performed without dismantling the magnetized tip from the driving tool.

7. A handheld driving tool for rotatably driving fasteners with a tool bit, the tool comprising:

a) a rotatable hollow shaft;

b) a handle secured to one end of the shaft for holding the tool and rotating the hollow shaft;

c) an annular socket secured to the other end of the shaft and having a socket opening shaped to engage a tool bit for driving the fastener; and d) an extendable member accommodatable in the hollow shaft, the extendable member having a magnetized end;

wherein the extendable member is extendable outwardly of the hollow shaft to dispose the magnetized end remotely from the hollow shaft.

8. A tool according to claim 7 wherein the extendable member has an extended configuration and a retracted configuration and wherein in the retracted configuration the extendable member is retracted and within the tool.

9. A tool according to claim 7 wherein the extendable member comprises multiple telescopic tubes slidable one within the other.

10. An extensible magnetic screwdriver comprising:

a) a handle;

b) a hollow outer sleeve having an interior, being connected to the handle and having a forward opening with respect to the handle;

c) a screwdriver bit engageable with the forward opening;

d) an extensible pipe; and e) a magnetic chuck disposed on a forward end of the extensible pipe;

wherein the extensible pipe is extensible from the forward opening to enable the magnetic chuck to reach into a deep hole.

11. A screwdriver according to claim 10 wherein the extensible pipe is extended and located so that the magnetic chuck reaches the bolt in the deep hole.

12. A screwdriver according to claim 10 comprising a plurality of extensible pipes.

* * * * *